United States Patent [19]

Terashima

[11] 4,147,127

[45] Apr. 3, 1979

[54] TONER CONCENTRATION DETECTING APPARATUS

[75] Inventor: Isamu Terashima, Hitachi, Japan

[73] Assignee: Hitachi, Ltd., Japan

[21] Appl. No.: 841,737

[22] Filed: Oct. 13, 1977

[30] Foreign Application Priority Data

Oct. 16, 1976 [JP] Japan ..... 51-124272

[51] Int. Cl.[2] ..... G03G 13/09

[52] U.S. Cl. ..... 118/646; 118/658

[58] Field of Search ..... 118/646, 657, 658, 7; 222/DIG. 1

[56] References Cited

U.S. PATENT DOCUMENTS

| | | | |
|---|---|---|---|
| 3,058,405 | 10/1962 | Limberger | 118/657 |
| 3,572,551 | 3/1971 | Gillespie et al. | 118/646 |
| 3,802,381 | 4/1974 | O'Neill et al. | 118/7 |
| 3,892,672 | 1/1975 | Gawron | 118/7 |
| 3,893,408 | 7/1975 | Lamel | 118/7 |
| 3,932,034 | 1/1976 | Takahashi | 118/646 |
| 3,999,687 | 12/1976 | Baer et al. | 222/DIG. 1 |
| 4,054,230 | 10/1977 | Suzuki et al. | 221/DIG. 1 |

FOREIGN PATENT DOCUMENTS 46-8280 2/1971 Japan.

*Primary Examiner*—Mervin Stein

*Attorney, Agent, or Firm*—Craig & Antonelli

[57] ABSTRACT

A detecting coil is placed in the flow of a developer (developing agent) including a magnetic carrier and a coloring toner, which is fed by developer-feeding means. The detecting coil is shaped in a flat plate in a direction perpendicular to the coil axis, which in turn is substantially at right angles to the direction of the flow of the developer.

6 Claims, 4 Drawing Figures

TONER CONCENTRATION DETECTING APPARATUS

BACKGROUND OF THE INVENTION

This invention relates to a toner concentration-detecting apparatus for a developer comprising a magnetic carrier and a toner in a developing apparatus.

Methods for detecting the concentration of the toner of a two-component developer comprising a magnetic carrier and a toner by utilizing variations in inductance are suggested in the Japanese Patent Publication No. 8280/71 and U.S. Pat. No. 3,802,381. According to these methods, variations in magnetic permeability of the developer in accordance with the mixing ratio of the magnetic carrier and the non-magnetic toner are detected in the form of variations in coil inductance.

A two-component developer comprising a mixture of magnetic carrier such as iron powder and black toner powder is usually used with a magnetic brush for development. The magnetic field formed by a magnet making up the magnetic brush is apt to act on toner concentration-detecting coils, resulting in an error in coil induction detection.

Although the toner concentration can be measurable in theory by embedding the detecting coils in the developer for detection of induction variations, the toner concentration-detecting means has, in actual fact, been placed under the influence of the magnetic field formed by the roll magnet making up the magnetic brush. Generally, the magnetic brush is comprised of a fixed magnet on the outer periphery of which a sleeve is rotated to supply the developer onto a photosensitive surface. For this purpose, the sleeve is generally made of a non-magnetic metal such as brass, stainless steel or aluminum. With the rotation of the sleeve, eddy currents occur, thereby often causing variations in magnetic field in the developer. Therefore, the mere embedding of coils in the developer case or container is not enough for correct measurement of inductance.

Further, the magnetic field formed by the magnet making up the magnetic brush magnetically saturates the magnetic carrier. The difference in saturation degree due to the temperature characteristics of the magnet or changes thereof with time and the resulting variations in inductance are detected as an error.

Preferably, the detecting coils or the contact area of the coils with the developer should be larger to enable toner concentration detection over a larger portion of the developer. Nevertheless, each coil should be of an appropriate size in order to assure the compactness of the detecting apparatus and the developer container.

Furthermore, the fact that the detecting coils are located within the developer container disturbs homogeneous circulation flow of the developer, inconveniently resulting in a lack of uniformity of the magnetic brush.

Some of the conventional apparatus for detecting the toner concentration of the developer such as disclosed in U.S. Pat. No. 3,572,551, in order to obviate the above-mentioned disadvantages, are so constructed that the detecting coils are not placed in the developer container but part of the developer is taken out of the developer circulation path in the developing apparatus to measure the toner concentration at a point separate from the container not affected by the above-mentioned problems. This type of apparatus, however, is bulky and complicated, and has the shortcoming of low reliability.

SUMMARY OF THE INVENTION

An object of the present invention is to obviate the above-mentioned disadvantages of the conventional apparatus and to provide a toner concentration-detecting apparatus compact, simple in construction and high in reliability.

According to the present invention, there is provided a toner concentration-detecting apparatus comprising detecting coils placed in the flow of the developer fed by the developer-feeding means, each detecting coil being shaped in a flat plate perpendicular to the coil axis, so that the coil axis is substantially at right angles to the direction of flow of the developer.

DESCRIPTION OF THE PREFERRED EMBODIMENTS

Figure 1:
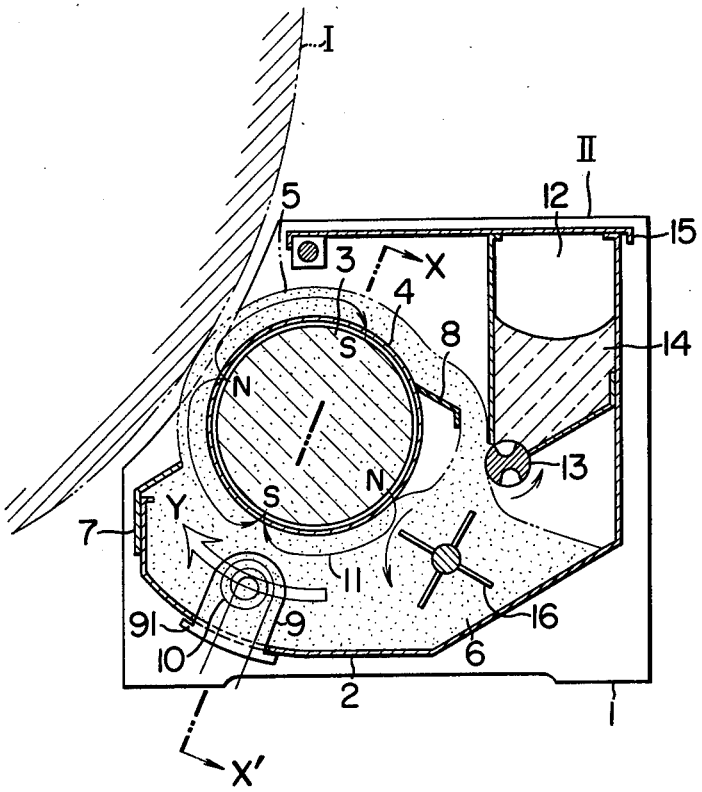
FIG. 1 is a diagrammatic longitudinal sectional view of a developing apparatus having a toner concentration-detecting apparatus according to an embodiment of the present invention.

A longitudinal sectional view of the developing apparatus with the toner concentration-detecting apparatus according to an embodiment of the present invention is shown in FIG. 1, in which reference character I shows a photosensitive drum, and character II a developing apparatus.

Numeral 1 shows a side plate making up the developing apparatus II, numeral 2 a case or container supported on the side plate 1 for containing the developer 6, numeral 3 a fixed magnet with its magnetic poles located along the circumference thereof. The fixed magnet 3 is fixedly supported on the side plates 1 and has on the outer periphery thereof a rotatably supported non-magnetic sleeve 4. This sleeve 4 is rotated clockwise as shown in the drawing by a motive power not shown, so that the developer 6 is circulated thereby to form a well-known magnetic brush 5 at the upper part. Numeral 7 shows a scraping plate for regulating the height of the brush in order to maintain uniform and proper amount of the magnetic brush 5 in contact with the photosensitive drum I, and numeral 8 a doctor blade for removing the developer after developing the latent image on the photosensitive drum I.

Figure 3:
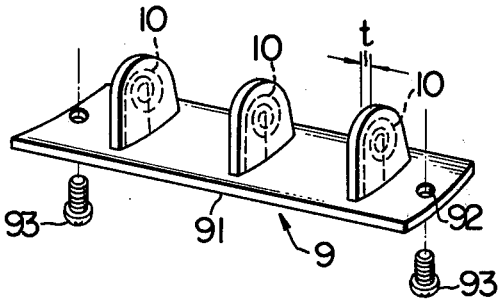
FIG. 3 is a perspective view of the toner concentration-detecting apparatus according to the embodiment of FIG. 1.

Numeral 9 shows a detector including a coil 10 the outside surface of which is molded with an insulating varnish or plastic in flat form perpendicular to the coil axis. Specifically, the flat coil mold is as thin as 1 mm. It is of course possible to do without varnish or plastic molding if the coil 10 has sufficient strength. Each of the coils 10 is wound in 100 to 300 turns and has an inductance of several milli-henry, the diameter thereof being approximately 10 mm. The coil without any core may have a sufficiently high detecting ability. The detector 9 has an appearance best shown in FIG. 3. Three coils are fixed on a common support 91 and inserted into the holes 21 which, formed in the bottom of the developer case 2, have a size sufficient to accomodate the coils. Thus the detector 9 is removably fitted in the bottom of the case 2 by use of the screws 93 through the screw holes 92.

The coils 10 are placed within the flow of the developer (in the direction shown by arrow Y) in such a manner that the coil axis is substantially perpendicular to the flow Y of the developer. The developer uniformly flows in circulation by the rotation of the sleeve 4 and the permanent magnet 3 making up the magnetic brush 5. In order to improve the accuracy of toner concentration detection, the coils 10 are preferably located in an environment free from the effect of the magnetic fluxes caused by the permanent magnet 3 and that of the magnetic fluxes caused by the eddy current produced in the sleeve 4. For this purpose, the coils 10 may be located on or in the vicinity of an extension of the straight line or polar line connecting the same type of poles of the magnet 3 (S poles in FIG. 1). Also, the coil axis is substantially parallel to the rotational axis of the sleeve 4.

Numeral 12 shows a hopper containing supply toner 14, and has a supply valve 13 at the lower part thereof. By rotating the supply valve 13 in the direction of the arrow, the toner 14 is supplied by a predetermined amount at a time. Numeral 15 shows a cover of the developing apparatus II, and numeral 16 an agitator rotated in operatively interlocked relation with the sleeve 4 for attaining the uniformity of the mixture of the magnetic carrier and the toner.

Figure 2:
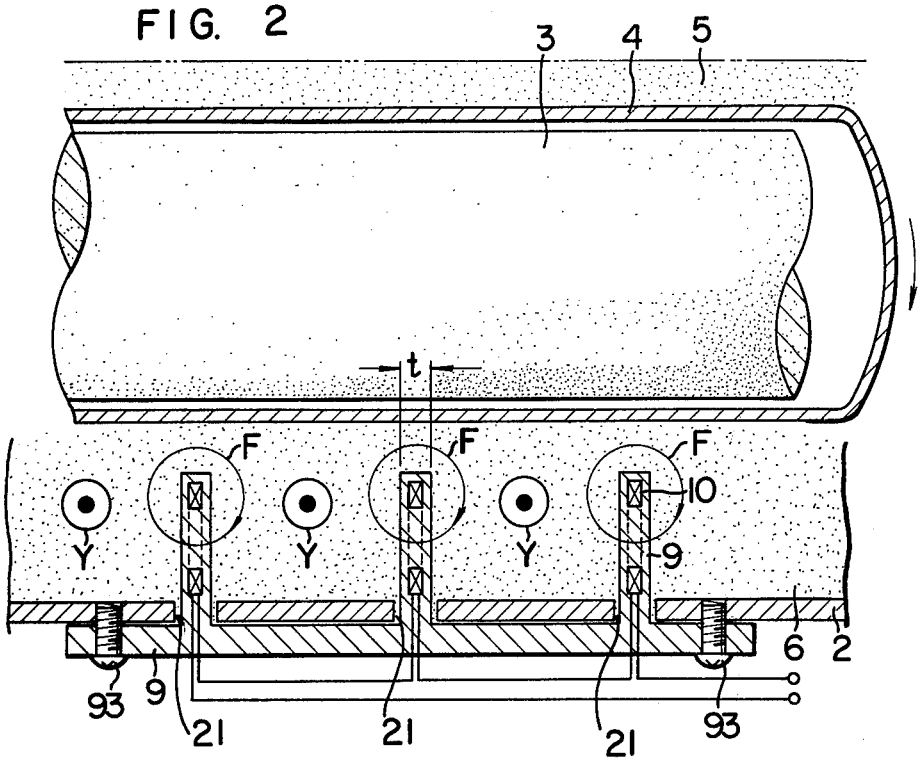
FIG. 2 is a diagrammatic longitudinal sectional view taken in line X–X' in FIG. 1.

The sectional view taken in line X–X' in FIG. 1 is shown in FIG. 2, which illustrates the relation between the detector 9 and the direction Y of movement of the developer 6 and the direction of magnetic field F of the coils 10.

In view of the fact that the coils 10 of the detector 9 are formed flat and arranged parallelly at spacial intervals to each other with the coil axes perpendicular to the flow Y of the developer 6, the flow of the developer 6 is not disturbed nor the uniformity of the magnetic brush 5 adversely affected.

In order to improve the sensitivity of the coils 10 by increasing the magnetic fluxes produced therefrom and entering the developer 6, the thickness t of the coils 10 along the axis thereof is preferably smaller. In spite of this, a too small thickness of the coils 10 reduces the mechanical strength of the detector 9. Generally, the proper ratio between the coil diameter and thickness t (which is the thickness of a mold, if any, including the coil and plastic or other molding material) is 2 to 1 ranging up to 10 to 1.

Figure 4:
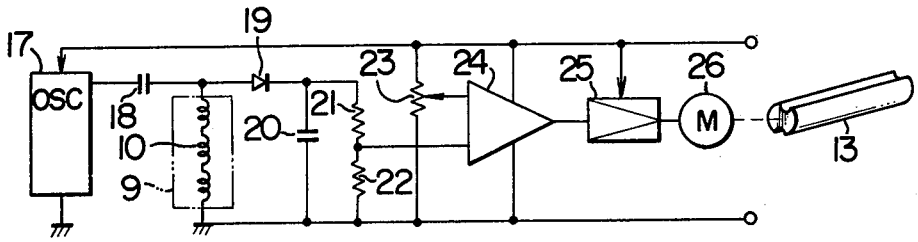
FIG. 4 is a circuit diagram showing an embodiment of a toner concentration control circuit using the toner concentration-detecting apparatus.

An example of the toner concentration control circuit is shown in FIG. 4.

Numeral 17 shows a crystal oscillator for producing a regular sine or square wave of a frequency of approximately 100 KHz. Numeral 18 shows a coupling capacitor for coupling the detector 9 to the coils 10 in almost resonant state. In accordance with the concentration of the toner in the developer 6, the voltage across the plurality of series-connected coils undergoes a change. This voltage is rectified by a diode 19, smoothed by a smoothing capacitor 20, and divided into appropriate voltages by voltage-dividing resistors 21 and 22. This divided voltage is set at a reference voltage equivalent to a predetermined toner concentration by the potentiometer 23, so that the toner concentration is accurately determined by a differential amplifier 24.

The differential amplifier 24 is adapted to produce a signal only when the toner concentration is lower than a predetermined value.

Numeral 25 shows a power amplifier including a circuit for producing pulses at regular intervals of time only when the differential amplifier 24 produces a signal. These pulses are used to drive the step motor 26 coupled to the supply valve 13 in FIG. 1 for supplying the toner.

The contact of the magnetic brush 5 with the photosensitive drum I reduces the toner quantity each time of development, thus reducing the concentration of the toner of the developer 6. When the toner concentration is reduced below a predetermined level, the signal from the detector 9 regulates the supply valve 13 to supply the toner 14. In this way, the developer 6 is always maintained in proper toner concentration.

It will be understood that the present invention has various advantages as explained below.

(1) Since the toner concentration is detected within the developing apparatus, a sampling system which otherwise might be necessary for measuring the toner concentration of the developer moved to a separate measuring point is not required, thus providing a compact, simple and reliable apparatus.

(2) The fact that a plurality of flat coils are arranged along the flow of the developer does not disturb the developer flow, thereby making possible stable toner concentration detection.

(3) The axes of the coils are arranged in the direction substantially at right angles to the developer flow and the coils are located on or in the vicinity of the polar line of the magnet, so that the apparatus according to the invention is rarely affected by variations in magnetic field attributable to the magnet, thereby improving the accuracy of the apparatus.

(4) A plurality of coils are arranged at predetermined regular spacial intervals to each other, and therefore it is difficult for them to be adversely affected by any variations in concentration or mixing ratio, or pressure (or density).

(5) The flat form of the coils increases the sensitivity thereof.

It will thus be seen that according to the present invention, each of the detecting coils are formed in a flat plate perpendicular to the axis thereof which intersects with the flow of the developer at right angles to each other. The result is an increased sensitivity, making possible accurate detection with little effect from the magnetic field produced by the magnet. The detection of toner concentration is thus substantially made possible within the developing apparatus and the need for the sampling system is eliminated, thereby producing a compact, simple and reliable toner concentration-detecting apparatus.

I claim:

1. In an apparatus used with a developing apparatus for detecting the concentration of a toner comprised in a developer, said detecting apparatus comprising developer feeder means and said developer including a magnetic carrier and a coloring toner, said developer feeding means including a fixed permanent magnet and a non-magnetic sleeve rotatably mounted around the outer periphery of said permanent magnet, said developing apparatus being adapted for image development by use of a developer magnet brush made of said permanent magnet, the improvement further comprising at least one detecting coil magnetically acting upon said developer, said detecting coil being formed in a flat plate perpendicular to the axis thereof, said detecting coil being located in the flow of said developer in such a manner that said coil axis intersects with the direction of the flow of said developer substantially at right angles to each other.

2. A toner concentration-detecting apparatus according to claim 1, in which a plurality of said detecting coils are arranged at predetermined spacial intervals to each other with the axes thereof perpendicular to the flow of said developer.

3. A toner concentration-detecting apparatus according to claim 1, in which said detecting coil is located in selected one of the positions on and in the vicinity of the polar line of said permanent magnet.

4. A toner concentration-detecting apparatus according to claim 1, in which the axis of said detecting coil is substantially in parallel to the rotational axis of said sleeve.

5. A toner concentration-detecting apparatus according to claim 1, in which detecting coils are mounted on a common support and the assembly of said detecting coils and the common support is removably mounted on a case containing said developer from outside of said case in such manner that the detecting coils are inserted through apertures provided in said case into said developer.

6. A toner concentration-detecting apparatus according to claim 5, in which the detecting coils and common support are formed integrally.

* * * * *